United States Patent [19]

Dahm

[11] 4,144,849

[45] Mar. 20, 1979

[54] LIQUID-COOLED INTERNAL COMBUSTION ENGINE

[75] Inventor: Wolfram Dahm, Nürtingen, Fed. Rep. of Germany

[73] Assignee: Daimler-Benz Aktiengesellschaft, Fed. Rep. of Germany

[21] Appl. No.: 785,081

[22] Filed: Apr. 6, 1977

[30] Foreign Application Priority Data

Apr. 10, 1976 [DE] Fed. Rep. of Germany ..... 2615727

[51] Int. Cl.[2] ..... F01P 11/02; F01P 11/04; F01P 7/16

[52] U.S. Cl. ..... 123/41.54; 123/41.1

[58] Field of Search ..... 236/34.5; 123/41.08, 123/41.09, 41.1, 41.27, 41.54; 236/34.5; 237/8 C, 12.3 B

[56] References Cited

U.S. PATENT DOCUMENTS

| | | | |
|---|---|---|---|
| 1,346,331 | 7/1920 | Muir | 123/41.09 |
| 1,658,934 | 2/1928 | Muir | 123/41.54 |
| 2,332,680 | 10/1943 | Wallace | 123/41.08 X |
| 2,336,068 | 12/1943 | Charles | 123/41.54 X |
| 2,790,605 | 4/1957 | Peterson et al. | 237/12.3 B |
| 3,132,634 | 5/1964 | Butler | 123/41.54 |
| 3,221,720 | 12/1965 | Dangauthier | 123/41.09 |
| 3,726,262 | 4/1973 | Moon | 123/41.1 |
| 3,851,629 | 12/1974 | Mayr et al. | 237/12.3 B |
| 3,921,600 | 11/1975 | Henning et al. | 123/41.08 X |

FOREIGN PATENT DOCUMENTS

| | | | |
|---|---|---|---|
| 1288360 | 1/1969 | Fed. Rep. of Germany | 123/41.54 |

*Primary Examiner*—Charles J. Myhre
*Assistant Examiner*—Jeffrey L. Yates
*Attorney, Agent, or Firm*—Craig & Antonelli

[57] ABSTRACT

A liquid-cooled internal combustion engine with a control of the cooling medium temperature of its cooling medium circulation by a thermostatically operating mixing valve which includes a mixing chamber in open communication with the suction connection of a circulating pump interconnected into the cooling medium circulation, a return chamber adapted to be closed off with respect to the mixing chamber by a return control valve and connected with the cooling medium outlet of a radiator by way of a radiator return line, and a by-pass channel connected with the cooling medium outlet of the internal combustion engine and adapted to be closed off with respect to the mixing chamber by a by-pass control valve; the cooling medium outlet line of the mixing valve is connected by way of a radiator inlet line with the radiator inlet of the radiator while the return chamber is connected by way of a vent connection with an auxiliary chamber fed with cooling medium by the circulating pump by way of the radiator inlet line for the formation of a liquid seal; the auxiliary chamber, which in its turn is provided with a vent connection leading to a geodetic high-point of the cooling medium circulatory system serving for the air separation, is located in series between two vent lines, of which one is connected to the return chamber and the other to the radiator inlet line.

8 Claims, 3 Drawing Figures

LIQUID-COOLED INTERNAL COMBUSTION ENGINE

The present invention relates to a liquid-cooled internal combustion engine with a control of the cooling medium temperature of its cooling medium circulatory system by a thermostatically operating mixing valve, which includes a mixing chamber in open communication with the suction connection of a circulating pump interconnected into the cooling medium circulation and a return chamber connected by way of a radiator return line with the cooling medium outlet of a radiator and adapted to be closed off with respect to the mixing chamber by a return control valve, as well as a by-pass channel connected with the cooling medium outlet of the internal combustion engine, and adapted to be closed off with respect to the mixing chamber by a by-pass control valve, and whose cooling medium oulet is connected with the cooling medium inlet of the radiator by way of a radiator inlet line, and in which the return chamber is connected by way of a venting connection with an auxiliary-chamber fed with cooling medium by the circulating pump by way of the radiator inlet line for the formation of a liquid seal and in which the auxiliary chamber, in its turn, has a venting connection to a geodetic high-point of the cooling medium circulation serving the air separation.

An internal combustion engine of this type represents an internal, non-public development in the facilities of the assignee of the present application. In this internal combustion engine, the two control valves are actuated by an expansion element inserted into the mixing chamber, which responds to the temperature of the cooling medium that establishes itself in the mixing chamber. With a cold engine, the return control valve is closed, whereas, in contradistinction thereto, the by-pass control valve is opened. During the filling of the cooling system, the auxiliary chamber is emptied so that the return chamber together with the radiator return line connected thereto are provided with a filling ventilation by way of the auxiliary chamber. During the operation of the internal combustion engine, the liquid seal of the auxiliary chamber prevents in those operating phases, in which the return control valve is opened, the sucking-in of air by the circulating pump by way of the filling ventilation system of the return chamber.

The present invention is concerned with the task to keep as small as possible the structural expenditure for the filling ventilation system of the return chamber in connection with the aforedescribed internal combustion engine representing the internal, non-public development in the facilities of the assignee of the present application.

The underlying problems are solved in an advantageous manner according to the present invention in that the auxiliary chamber is located in series between two vent lines, of which one is connected to the return chamber and the other is connected to the radiator inlet line.

In the internal combustion engine according to the present invention, the radiator inlet line assumes essentially the removal of the vent particles out of the auxiliary chamber during the filling of the cooling system so that the expenditures in lines for this purpose are kept as small as possible.

In internal combustion engines with a thermostatically operating mixing valve, it is customary that the mixing valve includes two communicating valve connections, of which one valve connection connects the by-pass channel with the cooling medium outlet of the internal combustion engine and the other valve connection connects the radiator inlet line with the cooling medium outlet of the internal combustion engine.

In application of the present invention to such an internal combustion engine, the arrangement may be made in an advantageous manner such that the mixing valve includes a housing channel which connects a vent connection of the return chamber with a vent connection in the valve connection for the radiator inlet line.

In this manner, optimally short line paths for the filling ventilating system of the return chamber are obtained.

Accordingly, it is an object of the present invention to provide a liquid-cooled internal combustion engine which avoids by simple means the aforementioned shortcomings and drawbacks encountered in the prior art.

Another object of the present invention resides in a liquid-cooled internal combustion engine in which the length of lines is kept as short as possible, especially for the venting system of the mixing chamber.

A further object of the present invention resides in a liquid-cooled internal combustion engine which is characterized by extremely efficient operation, yet is relatively simple in construction and utilizes relatively simple, few parts.

Still a further object of the present invention resides in a liquid-cooled internal combustion engine in which a liquid seal is used to prevent the drawing-in of air by the circulating pump during the operation of the engine notwithstanding the presence of a fill-in venting system.

These and further objects, features and advantages of the present invention will become more apparent from the following description when taken in connection with the accompanying drawings, which show, for purposes of illustration only, one embodiment in accordance with the present invention, and wherein.

Figure 1:
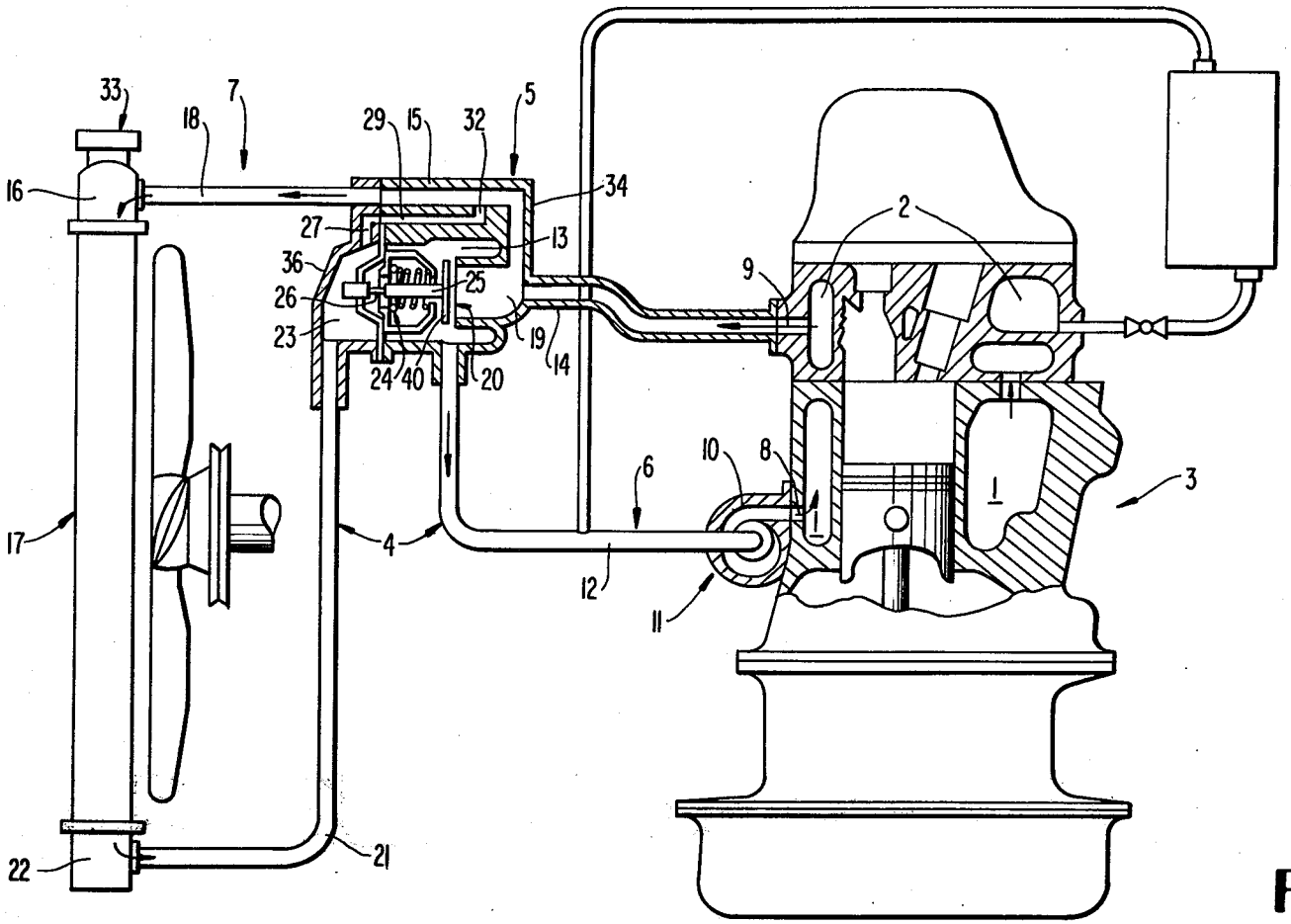
FIG. 1 is a schematic view of the cooling medium circulatory system of the internal combustion engine according to the present invention.

Referring now to the drawings wherein like reference numerals are used throughout the various views to designate like parts, the cooling spaces 1 and 2 of the internal combustion engine generally designated by reference numeral 3, which are traversed sequentially by the cooling medium, are interconnected in a cooling medium circulatory system generally designated by reference numeral 4 which is subdivided by a thermostatically operating mixing valve generally designated by reference numeral 5, into a by-pass circulation generally designated by reference numeral 6 and into a radiator circulation generally designated by reference numeral 7. The cooling medium inlet and the cooling medium outlet of the internal combustion engine 3 are designated by reference numerals 8 and 9.

A circulating pump 11 which is connected with its pressure connection 10 to the cooling medium inlet 8 and which is driven by the internal combustion engine 3, is in open communication on its suction side by way of a suction line 12 with a mixing chamber 13 of the mixing valve 5. The mixing valve 5 is provided with two communicating valve connections 14 and 15 for the cooling medium outlet 9 of the internal combustion engine 3 and for a cooling medium inlet line 18 which leads to an upper water tank or box 16 of a radiator 17. A by-pass channel 19 of the mixing valve 5, which is connected with the cooling medium outlet 9 by way of the valve connection 14, is connected with the mixing chamber 13 by way of a by-pass control valve generally designated by reference numeral 20. A return chamber 23 of the mixing valve 5 which is connected with the lower water tank or box 22 of the radiator 17 by way of a radiator return line 21, is connected with the mixing chamber 13 by way of a return control valve generally designated by reference numeral 24. The control valves 20 and 24 are actuated in a conventional manner by a cylinder 25 of an expansion element, which is arranged in the mixing chamber 13 and is filled with a temperature-sensitive expansion material, and whose piston rod 26 is locally fixed in the mixing valve 5.

A venting connection indicated at 27 is provided in the housing of the mixing valve 5 for the return chamber 23, which is connected with a venting opening 32 in the valve connection 15 for the radiator inlet line 18 by way of a housing channel 29 which operates as auxiliary chamber with liquid seal and also extends inside of the housing of the mixing valve 5.

During the filling of the cooling system by way of the opened filler connection 33 of the upper water box 16, the return control valve 24 is closed. Air enclosed or entrapped in the line system 21, 23 escapes into the atmosphere by way of parts 27-29-32-18-33.

During the operation of the internal combustion engine, water droplets or water pearls continuously enter the housing channel 29 from the valve connection 15 of the radiator inlet line 18 by way of the vent opening 32, where they act in the manner of a liquid seal and prevent — with a slightly lowered liquid level in the radiator 17 and therewith in the cooling inlet line 18 — the drawing-in of air out of the upper water box 16 by the circulating pump 11 which otherwise would lead to a breaking-away or separation of the cooling medium stream as a result of an air bubble.

Figure 2:
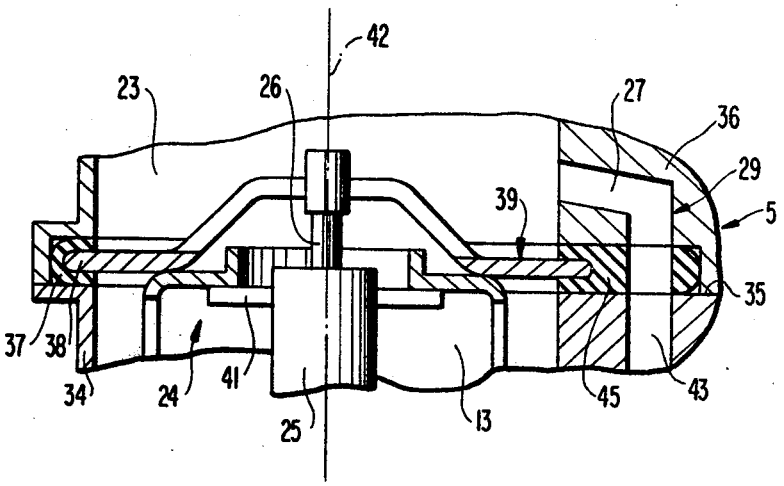
FIG. 2 is a partial axial cross-sectional view through the mixing valve of FIG. 1, on an enlarged scale, and illustrating certain details thereof.
Figure 3:
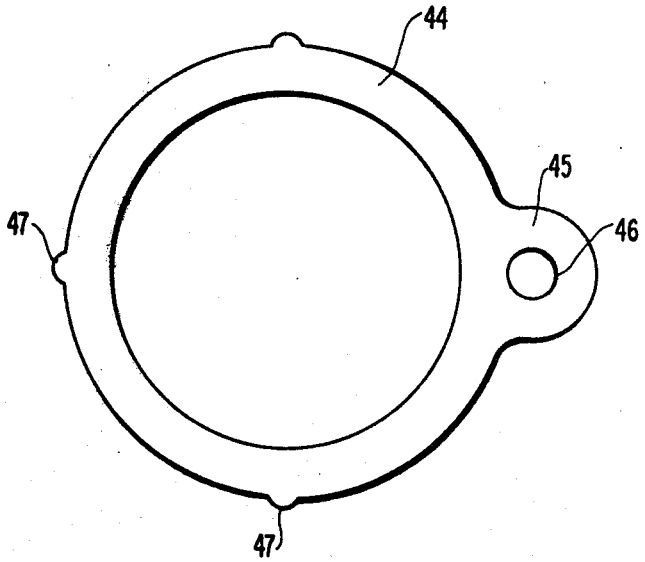
FIG. 3 is a plan view on the annular seal of FIG. 2, illustrated as an individual part.

The mixing valve 5 consists of a valve housing 34 (FIG. 2) having a separating surface 35, on which is placed a valve housing cover 36 having a corresponding separating surface 37 whereby the edge 38 of a valve seating disk generally designated by reference numeral 39 is simultaneously clamped-in. The mutually coaxially disposed valve disks or plates 40 (FIG. 1) and 41 (FIG. 2) of the by-pass control valve 20 and of the return control valve 24 are retained at the valve seating disk 39 in a conventional manner. The housing channel 29 includes a channel section 43 extending parallel to the common axis 42 (FIG. 2) of the valve disks 40 and 41, which extends through the separating surfaces 35 and 37. The edge 38 is surrounded by an annular seal 44 which at the location of the housing channel 29 includes a tongue-like tab or lug 45 with a cylindrical through-flow opening 46 (FIG. 3) which is aligned with the channel section 43 in the installed position. For securing this installed position, the annular seal 44 is provided at its outer circumference with three fixing nose portions 47.

While I have shown and described only one embodiment in accordance with the present invention, it is understood that the same is not limited thereto but is susceptible of numerous changes and modifications as known to those skilled in the art, and I therefore do not wish to be limited to the details shown and described herein but intend to cover all such changes and modifications as are encompassed by the scope of the appended claims.

I claim:

1. A liquid-cooled internal combustion engine having a cooling medium outlet and a control of the cooling medium temperature of its cooling medium circulation, comprising a circulating pump having a suction connection, thermostatically operating mixing valve means, said mixing valve means including a mixing chamber means, the suction connection of said circulating pump being interconnected in the cooling medium circulation in substantially open communication with the mixing chamber means, radiator means having an inlet, an outlet, and inlet and return lines for the cooling medium, a return chamber means operatively connected with the cooling medium outlet of the radiator means by way of the cooling medium return line, a return control valve means for closing off the return chamber means with respect to the mixing chamber means, and a by-pass channel means operatively connected with the cooling medium outlet of the internal combustion engine and by-pass control valve means for closing off the by-pass channel means with respect to the mixing chamber means, said mixing valve means further including a cooling medium outlet means operatively connected with the cooling medium inlet of the radiator means by way of a radiator inlet line, and vent means for the return chamber means including an auxiliary chamber means which includes a vent connection at a geodetic high place in the cooling medium circulation serving for the air separation, characterized in that two vent lines are provided, the auxiliary chamber means being arranged in series between said two vent lines, one of the vent lines being operatively connected with the return chamber means and the other vent line being operatively connected with the radiator inlet line in a manner enabling said circulating pump to supply cooling medium to said auxiliary chamber means via said other vent line so as to form a liquid seal in said auxiliary chamber means for preventing air from being drawn into the cooling system by the circulating pump upon an opening of the return control valve means due to the maintenance of said liquid seal being independent of the position of said return control valve means.

2. An internal combustion engine according to claim 1, in which the mixing valve means includes two communicating valve connection means, one of said two valve connection means operatively connecting the by-pass channel means with the cooling medium outlet of the internal combustion engine and the other of said two valve connection means operatively connecting the radiator inlet line with the cooling medium outlet of the internal combustion engine, characterized in that the mixing valve means includes a housing channel section forming said auxiliary chamber means which operatively connects said vent lines, and wherein said other vent line is operatively connected with the radiator inlet line by said other valve connection means.

3. An internal combustion engine according to claim 2, wherein the mixing valve means includes a valve housing and a valve housing cover, and wherein said by-pass control valve means and said return control valve means include valve disks and valve disk seat means, said valve disks being retained at the valve disk seat means and the valve disk seat means being clamped fast with its edge between corresponding separating surfaces of the valve housing and of the valve housing cover, characterized in that the auxiliary chamber means is formed by the housing channel section extending in proximity of the edge of the valve disk seat means, said housing channel section extending through the separating surfaces of the valve housing and of the valve housing cover.

4. An internal combustion engine according to claim 3, in which an annular seal is provided, the edge of the valve disk seat means cooperating with said annular seal, characterized in that the annular seal includes a radial tongue-like tab having an opening substantially aligned with said housing channel section.

5. An internal combustion engine according to claim 1, characterized in that the mixing valve means includes a housing channel section, said auxiliary chamber means being formed by said housing channel section.

6. An internal combustion engine according to claim 5, wherein the mixing valve means includes a valve housing and a valve housing cover, and wherein said by-pass control valve means and said return control valve means include valve disks and valve disk seat means, said valve disks being retained at said valve disk seat means and the valve disk seat means being clamped fast with its edge between corresponding separating surfaces of the valve housing and of the valve housing cover, characterized in that said housing channel section extends in proximity of the edge of the valve disk seat means, said housing channel section extending through the separating surfaces of the valve housing and of the valve housing cover.

7. An internal combustion engine according to claim 5, in which the edge of the valve disk seat means cooperates with an annular seal, characterized in that the annular seal includes a radial tongue-like tab having an opening substantially aligned with said housing channel section.

8. An internal combustion engine according to claim 7, characterized in that the annular seal includes means for assuring the correct position thereof with respect to the alignment of the opening in the tongue-like tab.

* * * * *